United States Patent [19]

Estes

[11] 4,354,829

[45] Oct. 19, 1982

[54] METHODS AND APPARATUS FOR CALCINING CARBONACEOUS MATERIAL

[75] Inventor: James W. Estes, Piscataway, N.J.

[73] Assignee: Airco, Inc., Montvale, N.J.

[21] Appl. No.: 258,825

[22] Filed: Apr. 29, 1981

[51] Int. Cl.[3] ..... F27B 7/32

[52] U.S. Cl. ..... 432/117; 202/100; 202/131; 202/216; 432/200

[58] Field of Search ..... 432/19, 23, 105, 103, 432/117, 200, 13; 201/27, 32, 36, 37; 202/100, 131, 216

[56] References Cited

U.S. PATENT DOCUMENTS 3,182,980 5/1965 Helfrich ..... 432/117

4,266,931 5/1981 Struckmann ..... 432/113

FOREIGN PATENT DOCUMENTS 1195560 6/1970 United Kingdom ..... 432/19

*Primary Examiner*—John J. Camby

*Attorney, Agent, or Firm*—David L. Rae; Larry R. Cassett

[57] ABSTRACT

The rate of calcining carbonaceous material in a rotary kiln is increased by enriching with oxygen air supplied into the kiln by fans. The introduction of oxygen is effected during a predetermined portion of each kiln revolution and is effective to enrich the oxygen content of air supplied to the kiln to approximately 23–25% oxygen. By so enriching the interior kiln atmosphere during calcining of material such as petroleum coke, greater temperatures are obtained than will be obtained by the use of air alone thereby accelerating the evolution of volatile materials and the combustion of such volatiles during calcination. The accelerated evolution and combustion of volatiles enables the rate at which carbonaceous material is calcined in a kiln of a given length to be increased.

10 Claims, 4 Drawing Figures

METHODS AND APPARATUS FOR CALCINING CARBONACEOUS MATERIAL

BACKGROUND OF THE INVENTION

The present invention relates to improved combustion processes and more particularly to improved methods and apparatus for calcining carbonaceous material such as petroleum coke.

Carbonaceous materials such as "green" petroleum coke are typically calcined in a rotary kiln by introducing these materials into the upper end of a slightly inclined kiln and heating the interior thereof to a temperature of approximately 2200°-2500° F. One technique for heating such a kiln is to fire an end burner disposed at the product outlet end or lower end of the kiln and directing a flame longitudinally through the kiln in the direction generally opposed to that of the product being calcined. This application of heat is effective to evolve or drive off volatile materials from the green carbonaceous material thereby increasing the density of such materials being calcined. As these gases are evolved from the green carbonaceous material, the heat within the kiln is effective to cause a combustion of such volatile gases which in turn releases heat to the kiln interior and enables the firing rate of the end burner to be reduced below a relatively high firing rate. Frequently, combustion of volatiles in the kiln will supply a majority of the heat required to calcine a green carbonaceous material such as petroleum coke. Typically, during calcination, at least 99% of the volatiles of a green carbonaceous material are evolved therefrom and are combusted as virtually complete volatilization is required in order to produce a calcined product of suitable quality. With regard to petroleum coke, calcination will typically be effective to increase the density thereof from approximately 1.6 to about 2.0 g/cm$^3$. This enables the resulting petroleum coke to be utilized for several purposes including use as a fuel.

In order to utilize the heat available in volatiles evolved during the calcining of carbonaceous material, it is known to introduce air in controlled quantities through a fan or blower mounted for revolution with the kiln itself. Such a system is illustrated in U.S. Pat. No. 2,813,822 which shows a kiln mounted blower adapted to supply controlled air flows through a plurality of tuyeres into the interior of the kiln. This forced introduction of air into the kiln is effective to improve the combustion of volatile gases evolved during the calcining of a material such as petroleum coke. More recently, it has been proposed in U.S. Pat. No. 3,888,621 to control the air supplied by a kiln mounted blower in response to interior kiln conditions. In this reference, apparatus for optically detecting smoke conditions within a kiln is provided such that the flow of air into the kiln is controlled thereby enabling an improved combustion of volatile materials while avoiding significant combustion of the carbonaceous material, i.e. petroleum coke. In addition, it is also known to adjust the residence time of a carbonaceous material in different portions of a rotary kiln so that combustion of volatile materials evolved from such carbonaceous materials may be improved. One such technique along these lines is illustrated in U.S. Pat. No. 3,966,560. Finally, it has also been proposed to optimize kiln temperatures by establishing reference temperatures at various locations of the kiln and adjusting the supply of air and kiln revolution rate, etc. in order to optimize calcination of carbonaceous materials as is described in U.S. Pat. No. 4,022,569.

Notwithstanding the foregoing improvements in processes and equipment for calcining carbonaceous material, it is frequently desirable to increase the rate at which a carbonaceous material can be adequately calcined in a rotary kiln of a predetermined size without incurring significant structural modifications and capital additions. Simply increasing the feed rate of carbonaceous material to the kiln will not result in a greater throughput of calcined material as volatiles in the material will not be volatilized sufficiently to increase density to predetermined levels. Consequently, increasing the material feed rate alone merely results in partial, incomplete volatilization which does not yield an acceptably calcined product. Increasing kiln speed alone will reduce the residence time of carbonaceous material in the kiln and will also result in incomplete volatilization and ineffective calcination. Thus, the prior art has exhibited a clear need for improving the throughput rates of rotary kilns utilized to effectively calcine carbonaceous material without extensive additional structural modifications and attendant costs.

OBJECTS OF THE INVENTION

It is an object of the present invention to provide improved methods and apparatus for calcining carbonaceous materials.

It is another object of the present invention to improve the calcination of carbonaceous materials by increasing the throughput of such materials through a rotary kiln without adversely affecting product quality.

It is still another object of the present invention to increase the throughput of rotary kilns utilized for calcining carbonaceous material without incurring extensive structural additions or significantly increasing capital costs of such apparatus.

It is an additional object of the present invention to provide methods and apparatus for efficiently increasing the temperature in a rotary kiln.

It is still a further object of the present invention to provide improved methods and apparatus for selectively enriching air supplied to a rotary kiln with oxygen during the calcination of carbonaceous material therein.

Other objects of the present invention will become apparent from the following description of exemplary embodiments thereof which follows and the novel features will be particularly pointed out in conjunction with the claims appended hereto.

SUMMARY

In accordance with the invention, apparatus for calcining carbonaceous material in a rotary kiln comprises means for defining an annular plenum chamber disposed circumferentially about the kiln and means for supplying oxygen enriched air from said plenum into the interior of said kiln. The plenum chamber is comprised of a pair of annular channel portions which, when juxtaposed with one another, define the above described annular chamber. One of said channel portions is fixed relative to the kiln while the other channel portion is mounted on the exterior of the kiln for rotation therewith. A fan is provided with each plenum chamber for either drawing oxygen enriched air through the plenum chamber and then into the fan inlet in one embodiment of the invention or forcing oxygen enriched air through the plenum chamber located downstream of the fan. In the first mentioned embodiment, substantially pure oxygen is supplied into an air inlet of the plenum chamber to enrich such air to an oxygen level of about 23–25% oxygen and the fan is kiln mounted. In the second embodiment, substantially pure oxygen is introduced into the air inlet of the fan to similarly enrich air supplied to the plenum chamber although the fan is mounted in a stationary position. The oxygen enriched air is passed from each plenum chamber and is introduced into the interior of the kiln by way of tuyeres or other suitable injection conduits. Appropriately actuated valves are disposed with or in such tuyeres or conduits to preclude oxygen enriched air from passing into direct contact with or upwardly through the bed of carbonaceous material being calcined.

By supplying oxygen enriched air into a rotary kiln during the calcining of carbonaceous material in accordance with the invention, the kiln temperature may be increased by approximately 100°–200° F. This increased temperature will enable an accelerated evolution and combustion of volatile materials contained in the feed supplied to the kiln and enables a greater volume of such volatilized materials to be combusted in a given kiln length. Consequently, carbonaceous material may be supplied to the kiln at a greater rate or kiln speed may be increased, or both, and effective calcining will be achieved due to the accelerated evolution and combustion of volatile materials which occurs under the higher kiln temperatures established by use of the oxygen enrichment apparatus according to the present invention.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENTS

Figure 1:
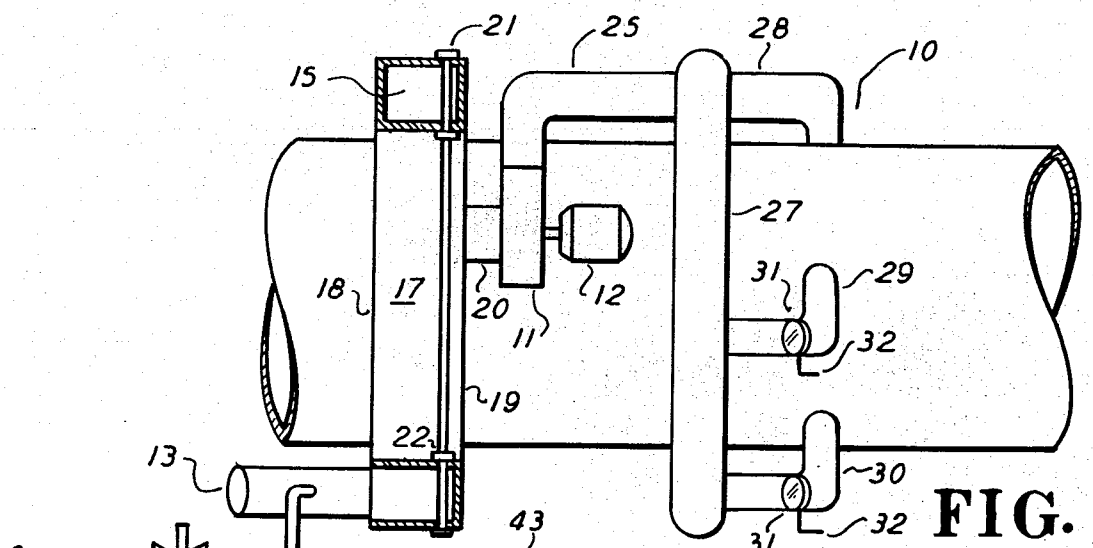
FIGS. 1 and 3 are elevational views of apparatus according to the invention for supplying oxygen enriched air to the interior of a rotary kiln.

The addition of oxygen enriched air into a rotary kiln at one or more locations between the product inlet and exit ends of the kiln can be achieved by use of apparatus which is illustrated in exemplary form in FIG. 1. A rotary kiln 10 is provided with a fan 11 mounted thereon and which fan is driven by a conventional electrical motor 12 mounted on the kiln. Suitable slip ring connections (not shown) may be utilized to supply electrical power to motor 12. In accordance with the invention, oxygen enriched air is supplied to the suction inlet 20 of fan 12. An air inlet conduit 13, to which oxygen is supplied through valve 16 and conduit 14, is disposed so as to communicate with an inlet of an annular plenum chamber 17 which extends circumferentially about the exterior of rotary kiln 10 and is preferably spaced away from the kiln by a predetermined distance. Plenum chamber 17 is comprised of first and second portions 18 and 19, each of which are annular channel members which when juxtaposed with one another are effective to define a substantially enclosed annular passage 15. Plenum portion 18 is mounted in a fixed position relative to kiln 10 while plenum portion 19 is mounted for rotation with kiln 10. Although plenum portions 18 and 19 are illustrated as substantially U-shaped channel members, it will be recognized that such portions could be configured in other geometrical forms, i.e. semicircular and that more than two portions could be employed to define plenum chamber 15. Seals 21 and 22, which will be described in greater detail hereinafter are preferably affixed to the exterior surface of plenum portion 18 to preclude leakage of oxygen enriched air from annular chamber 15 through gaps (typically about 0.25 in wide) between fixed portion 18 and portion 19. Seals 21 and 22 are preferably formed of a material such as Teflon as flexible strips and are mounted such that each seal slides across an exterior surface of the other plenum portion, i.e. portion 19. It will be understood that seals 21 and 22 are illustrative of seals that can be utilized with apparatus illustrated in FIG. 1.

Inlet 20 of fan 11 is connected to annular passage 15 of plenum chamber 17 while the outlet of fan 11 is connected through a conduit 25 which in turn is in communication with a manifold 27. A plurality of outlets 28, 29 and 30 extend from manifold 27 and are disposed in communication with the interior of kiln 10. Suitable valve means such as butterfly valves 31 which may be opened and closed upon actuation of a cam member 32 are disposed in outlets 28, 29 and 30 with two of such valve and cam members being illustrated in FIG. 1.

In operation, kiln 10 is rotated at a conventional speed of between approximately 0.75 and 2.0 ft/sec and a charge of material to be calcined, such as green petroleum coke, is supplied thereto to form a bed in the lower region of kiln 10. Motor 12 is energized to drive fan 11 which in turn causes a flow of air to be induced through conduit 13, annular passage 15 of plenum chamber 17 and through suction inlet 20 of fan 11. By supplying oxygen through valve 16 in conduit 14, this air flow will be enriched with oxygen to a predetermined extent, i.e. 23–25% or so and will thus enable higher temperatures to be maintained interiorly of kiln 10 and thereby enable a greater throughput of calcined carbonaceous material to be obtained upon operation of the kiln. The oxygen enriched air discharged by fan 11 will pass through conduit 25 and manifold 27 to outlets 28, 29 and 30 and will be introduced into the interior of kiln 10 for a predetermined portion of each revolution thereof. In order to avoid the discharge of oxygen enriched air upwardly through or directly into contact with a bed of carbonaceous material in kiln 10, cam 32 is actuated for a predetermined portion of each cycle of rotation which corresponds to the time during which each outlet 28, 29 and 30 is disposed, relative to the bed of carbonaceous material, to discharge oxygen enriched air therethrough. Typically, cam 32 will be actuated so as to close valve 31 as outlet 29 traverses a predetermined, lower portion of each revolution of kiln 10, thereby precluding the entry of oxygen enriched air directly through the bed of carbonaceous material as mentioned above. Consequently, oxygen enriched air will be introduced through outlet 28, 29 and 30 for the remaining portion of each revolution of kiln 10 to enable the aforementioned benefits of oxygen enrichment to be attained. Valves 31 in outlets 28 and 29 will also be closed as each such outlet traverses a lower region of kiln 10.

Figure 2:
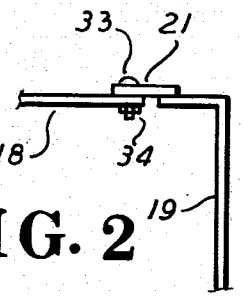
FIGS. 2 and 4 are partial diagrammatic views of sealing devices which may be employed with the apparatus depicted in FIGS. 1 and 3, respectively.

Upon operation of fan 11, oxygen enriched air will be drawn into annular passage 15 which will be maintained at a slight negative or vacuum pressure. By mounting seals 21 and 22 exteriorly of plenum portions 18 and 19, the seals which are preferably comprised of flexible Teflon strips will be biased inwardly toward annular passage 15. Consequently, the suction of fan 11 will tend to draw oxygen from passage 15 and will bias seals 21 and 22 into a sealing relationship with the exterior surface of each of portions 18 and 19. As illustrated in an exemplary fashion in FIG. 2, seal 21 may be bolted to the exterior surface of portion 18 by bolt 33 and nut 34. Clearly, any suitable means may be utilized to secure seals 21 and 22 to portion 18 of plenum chamber 17 and other sliding seal arrangements may be utilized in connection with the plenum chamber 17 described above.

Although the exemplary embodiment of apparatus according to the invention illustrated in FIG. 1 has depicted an air fan mounted on rotary kiln 10 for rotation therewith, apparatus for introducing oxygen enriched air into rotary kilns may utilize a fan which is stationary with respect to the rotary kiln. An embodiment of such apparatus is illustrated in an exemplary form in FIG. 2 and this apparatus includes a fan 37 which is provided with a suction inlet 35. Oxygen conduit 14 with valve 16 disposed therein is effective to supply oxygen into conduit 35 upon opening of valve 16 in a manner mentioned previously in connection with the above description of apparatus illustrated in FIG. 1. The outlet of fan 37 communicates with an annular chamber 28 formed by a plenum chamber 40 having a fixed portion 39 and a portion 41 which rotates with kiln 10 in a manner similar to the operation of portion 19 illustrated in FIG. 1. Fixed portion 39 of plenum chamber 40 is mounted on a suitable mounting means 42. Seals 43 and 44 are provided in the interior of annular chamber 38. Outlet conduits 45, 46 and 47 are disposed in communication with annular chamber 38 and are effective to supply an oxygen enriched air flow into the interior of kiln 10 for a predetermined portion of each revolution thereof. Although outlet 47 is shown in proximity to the inlet to chamber 38, it will be understood that as outlet conduit 47 rotates with respect to the inlet of chamber 38, there will be no unbalanced flow of oxygen enriched air through outlet conduit 47 or other outlet conduits 45 or 46. Appropriate valves, such as a butterfly valve 48 which is controlled by means of a cam 49 are provided to assure that oxygen enriched air is not supplied during a predetermined portion of revolution of kiln 10, i.e. when such supply of oxygen enriched air would pass through or into contact with the bed of carbonaceous material being calcined.

Figure 4:
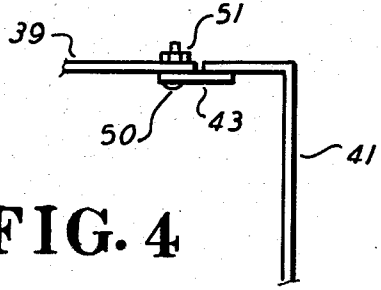
Figure 3:
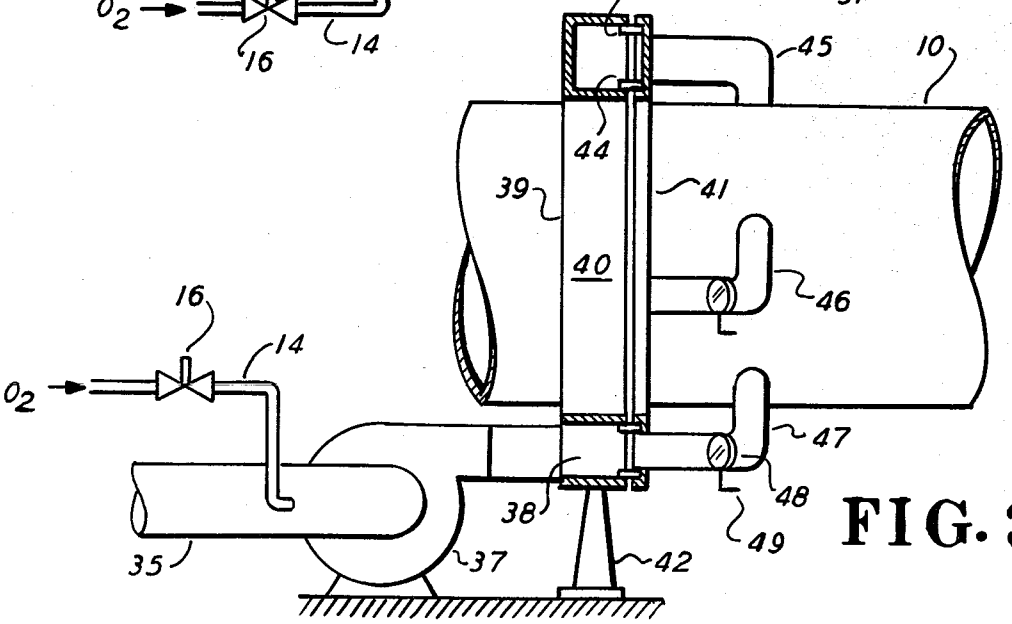

In operation of the apparatus illustrated in FIG. 3, kiln 10 is rotated and a charge of carbonaceous material to be calcined is introduced therein. Fan 37 is energized and oxygen is supplied through conduit 14 thereby enriching air drawn into fan 37 through conduit 35 with the oxygen enriched air being discharged into annular chamber 38 defined by fixed plenum portion 39 and rotating plenum portion 41 of plenum chamber 40. As the oxygen enriched air supplied to annular chamber 38 is at greater than atmospheric pressure, the use of seals in the form of flexible Teflon strips 43 and 44 will be effective to essentially seal the gap between fixed plenum portion 39 and rotating plenum portion 41. Such a seal may comprise a Teflon strip 43 bolted to fixed plenum portion 39 by means of a bolt 50 and nut 51 as illustrated in an exemplary manner in FIG. 4. The oxygen enriched air supplied to annular chamber 38 is then distributed through conduits 45, 46 and 47 into kiln 10 during a predetermined portion of each revolution thereof. As mentioned previously, the flow of oxygen enriched air into kiln 10 is preferably inhibited for a portion of each revolution so as to avoid the passage of such oxygen enriched air upwardly through or directly into contact with the bed of carbonaceous material being calcined. Thus, by engaging cam 49 as the same traverses a lower portion of each revolution of kiln 10, butterfly valve 48 may be actuated to a closed position thereby substantially impeding the flow of oxygen enriched air through a supply conduit, such as conduit 47, as illustrated in FIG. 3. It will be appreciated, however, that conduit 45 will also be provided with suitable selectively operated valve means to enable the flow of oxygen enriched air to be interrupted for a predetermined portion of each revolution of kiln 10.

It will be understood that by mounting fan 37 in a stationary position, as opposed to mounting such a fan on kiln 10 for rotation therewith, the use of exposed slip rings for supplying electrical power to the fan motor may be avoided thereby averting a potential safety hazard. In addition, fan maintenance, such as bearing replacement, may be effected more expeditiously and would not necessarily require interruption of kiln revolution as would be the case to repair fans mounted on kilns. Furthermore, by mounting fans such as fan 37 in a stationary position as illustrated in FIG. 3, such a fan can be located away from kiln 10 to enable use of fans which are not as resistant to high temperatures as fans mounted on kilns. The latter fans are, of course, more costly as the same must withstand high temperatures as a consequence of being mounted on the kiln.

It will be appreciated that "oxygen gas" is preferably substantially pure, commercially available oxygen; however, lower purity oxygen, e.g. 50–99% may be utilized to enrich air in accordance with the invention. In addition, although an end fired burner (not shown) is utilized to generate the kiln temperatures necessary for calcination, the firing rate of such burners may be substantially reduced due to the heat generated by combustion of volatile materials in the kiln.

The foregoing and other various changes in form and details may be made without departing from the spirit and scope of the present invention. Consequently, it is intended that the appended claims be interpreted as including all such changes and modifications.

What is claimed is:

1. Apparatus for calcining carbonaceous material comprising a rotary kiln; substantially annular plenum means disposed circumferentially about the exterior of said kiln, said plenum means including a first stationary portion and a second portion mounted for rotation with said kiln with said first and second portions being juxtaposed with respect to one another to define a substantially annular plenum chamber; fan means for passing oxygen enriched air through said plenum means and means for introducing said oxygen enriched air passed through said plenum means into the interior of said kiln.

2. The apparatus defined in claim 1 wherein said first and second portions have substantially U-shaped cross sections.

3. The apparatus defined in claim 1 wherein said first and second portions are spaced away from one another to define gaps therebetween and additionally comprising seal means disposed across said gaps to substantially preclude leakage of oxygen enriched air outwardly from said plenum chamber through said gaps.

4. The apparatus defined in claim 3 wherein said seal means comprise flexible strip material disposed in a circumferential configuration exteriorly about said annular plenum means.

5. The apparatus defined in claim 1 wherein said fan means are disposed in a stationary position and additionally comprising conduit means for connecting the outlet of said fan means with said plenum means.

6. The apparatus defined in claim 5 wherein said means for introducing said oxygen enriched air into said kiln comprise a plurality of outlet conduits each of which communicates with said plenum chamber and the interior of said kiln.

7. The apparatus defined in claim 6 additionally comprising valve means disposed in each of said outlet conduits for selectively interrupting the flow of said oxygen enriched air into said kiln interior for a predetermined portion of each kiln revolution.

8. The apparatus defined in claim 1 wherein said fan means are mounted for rotation with said kiln and additionally comprising conduit means for connecting the inlet of said fan means to said plenum means.

9. The apparatus defined in claim 8 wherein said means for introducing said oxygen enriched air into said kiln comprise a substantially annular manifold mounted for rotation with and disposed circumferentially about said kiln and having an inlet communicating with the outlet of said fan means; and a plurality of outlet conduits each of which communicates with the interior of said kiln.

10. The apparatus defined in claim 9 additionally comprising valve means disposed in each of said outlet conduits for selectively interrupting the flow of oxygen enriched air into said kiln interior for a predetermined portion of each kiln revolution.

* * * * *